US006324365B1

(12) United States Patent
Morikawa et al.

(10) Patent No.: US 6,324,365 B1
(45) **Date of Patent: *Nov. 27, 2001**

(54) ELECTROPHOTOGRAPHIC PHOTOSENSITIVE MEMBER, AND PROCESS CARTRIDGE AND ELECTROPHOTOGRAPHIC APPARATUS EMPLOYING THE SAME

(75) Inventors: Yosuke Morikawa; Hiroyuki Tanaka, both of Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/863,210

(22) Filed: May 28, 1997

(30) Foreign Application Priority Data

May 30, 1996 (JP) ..... 8-137066

(51) Int. Cl.[7] ..... G03G 15/00; G03G 15/02

(52) U.S. Cl. ..... 399/159; 399/174

(58) Field of Search ..... 399/110, 111, 399/149, 159, 174, 175, 310; 430/56, 57, 58, 127

(56) References Cited

U.S. PATENT DOCUMENTS

| | | | | |
|---|---|---|---|---|
| 4,056,390 | * | 11/1977 | Iizaka et al. | 399/310 X |
| 4,132,548 | * | 1/1979 | Nagai et al. | 399/310 |
| 5,126,913 | | 6/1992 | Araya et al. | 361/225 |
| 5,190,837 | | 3/1993 | Sakai et al. | 430/88 |
| 5,332,635 | | 7/1994 | Tanaka | 430/96 |
| 5,391,449 | * | 2/1995 | Maruyama et al. | 399/159 X |
| 5,592,266 | * | 1/1997 | Park et al. | 399/149 X |
| 5,666,192 | * | 9/1997 | Mashimo et al. | 399/174 |

FOREIGN PATENT DOCUMENTS

| | | |
|---|---|---|
| 0258889 | 3/1988 | (EP) . |
| 0576203 | 12/1993 | (EP) . |
| 0606074 | 7/1994 | (EP) . |
| 0645682 | 3/1995 | (EP) . |
| 0690352 | 1/1996 | (EP) . |
| 56-104351 | 8/1981 | (JP) . |
| 57-178267 | 11/1982 | (JP) . |
| 58-40566 | 3/1983 | (JP) . |
| 58-139156 | 8/1983 | (JP) . |
| 58-150975 | 9/1983 | (JP) . |
| 63-149668 | 6/1988 | (JP) . |
| 6-3921 | 1/1994 | (JP) . |

* cited by examiner

*Primary Examiner*—Sandra Brase
(74) *Attorney, Agent, or Firm*—Fitzpatrick, Cella, Harper & Scinto

(57) ABSTRACT

An electrophotographic photosensitive member is disclosed which has a photosensitive layer containing an organic charge-generating material and an organic charge-transporting material, and a surface layer containing electroconductive particles, and is charged electrically by a charging member placed in contact therewith. The photosensitive member has an electrostatic capacity of not less than 130 pF/cm$^2$. Also, a process cartridge and an employing the photosensitive member are disclosed.

14 Claims, 2 Drawing Sheets

ELECTROPHOTOGRAPHIC PHOTOSENSITIVE MEMBER, AND PROCESS CARTRIDGE AND ELECTROPHOTOGRAPHIC APPARATUS EMPLOYING THE SAME

BACKGROUND OF THE INVENTION

1. Field of the Invention

The present invention relates to an electrophotographic photosensitive member, and a process cartridge and an electrophotographic apparatus employing the electrophotographic photosensitive member. Particularly, the present invention relates to an electrophotographic photosensitive member which is electrically charged by a charging member placed in contact with it, and to a process cartridge and an electrophotographic apparatus employing the electrophotographic photosensitive member.

2. Related Background Art

Usual electrophotographic processes comprise charging of an electrophotographic photosensitive member, light image exposure of the photosensitive member, development of the formed electrostatic image, transfer of the developed image, fixation of the image, and cleaning of the photosensitive member. Conventionally, the electrical charging of the electrophotographic photosensitive member is conducted by application of a high voltage (DC 5–8 kV) by a metal wire to cause corona charging. This process has disadvantages that the corona products such as ozone and $NO_x$ degenerate the photosensitive member surface to cause blurring and deterioration of the image; and dirt on the wire causes blanks or black streaks in the image. In particular, the electrophotographic photosensitive member comprising an organic photoconductive substance is less stable chemically than inorganic photosensitive members such as a selenium photosensitive member or an amorphous silicon photosensitive member, and is liable to be degenerated by chemical reaction (mainly oxidation) on exposure to the corona products. Therefore, repeated corona charging causes image blurring owing to the degeneration of the photosensitive member, and drop of the copy density owing to the decrease of the sensitivity, resulting in a short printing or copying life of the photosensitive member.

Moreover, in the corona charging, only 5–30% of the entire current is directed to the photosensitive member, and a larger portion of the current flows to the shield plate, which lowers efficiency of the charging means.

To offset the above disadvantages, studies are made to conduct electrical charging with a charging member placed in contact with the electrophotographic photosensitive member without employing corona charger as disclosed in publications of Japanese Patent Application Laid-Open Nos. 57-178267, 56-104351, 58-40566, 58-139156, 58-150975, and so forth. Specifically, a charging member like an electroconductive elastic roller is placed in contact with the photosensitive member, and a DC voltage of about 1–2 kV is applied to the charging member to charge the surface of the photosensitive member at a prescribed potential.

However, the direct charging is liable to cause nonuniform charging, and dielectric breakdown of the photosensitive member.

To solve the above problems to improve the uniformity of the charging, a method is disclosed in which a superposition voltage of an AC voltage ($V_{AC}$) and a DC voltage ($V_{DC}$) is applied to the charging member (Japanese Patent Application Laid-Open No. 63-149668). In this method, the peak-to-peak voltage ($V_{pp}$) of the superposed AC should be twice or more times as high as the absolute value of the DC voltage to obtain the uniform charging effect.

However, with increase of the superposed AC voltage, dielectric breakdown becomes liable to be caused by the maximum voltage of the applied pulse voltage when slight defects are present in the photosensitive member. In particular, this dielectric breakdown is severe in the photosensitive member having a low dielectric strength. In such a case, a white blank can be formed in a positive development system, or a black band can be formed in a reversal development system in a length direction of the contact portion. If a pinhole is present, the current will leak through the pinhole site to drop the voltage applied to the charging member. The amount of the leakage current is so large that the photosensitive member may be damaged greatly as to be abraded and the durability is impaired, disadvantageously.

To solve the above problems, the publication of Japanese Patent Application Laid-Open No. 6-3921 discloses charging (injection charging) to inject electric charges directly to the surface layer of the photosensitive member without electric discharge. This charging method hardly damages the photosensitive member, since the difference between the voltage applied to the charging member and the surface potential of the photosensitive member is very small and ozone is not generated because of the direct injection of electric charge through a charging member to the surface layer (charge injection layer) containing electroconductive particles dispersed therein. However, this charging method has a disadvantage in that the charging tends to be nonuniform since the charge injection is conducted only at the contact points of the charging member.

With the demand for higher image quality in recent years, electrophotographic photosensitive members are being investigated which are capable of forming finer and more uniform picture images.

SUMMARY OF THE INVENTION

An object of the present invention is to provide an electrophotographic photosensitive member for injection charging for finer and more uniform picture images.

Another object of the present invention is to provide a process cartridge and an electrophotographic apparatus employing the electrophotographic photosensitive member.

The electrophotographic photosensitive member of the present invention comprises a support, a photosensitive layer containing an organic charge-generating material and an organic charge-transporting material on the support, and a surface layer containing electroconductive particles on the photosensitive layer, and is charged electrically by a charging member placed in contact therewith, wherein the electrophotographic photosensitive member has an electrostatic capacity of not less than 130 $pF/cm^2$.

The process cartridge of the present invention employs the aforementioned electrophotographic photosensitive member and the charging member.

The electrophotographic apparatus of the present invention employs the above process cartridge.

DESCRIPTION OF THE PREFERRED EMBODIMENTS

Figure 1:
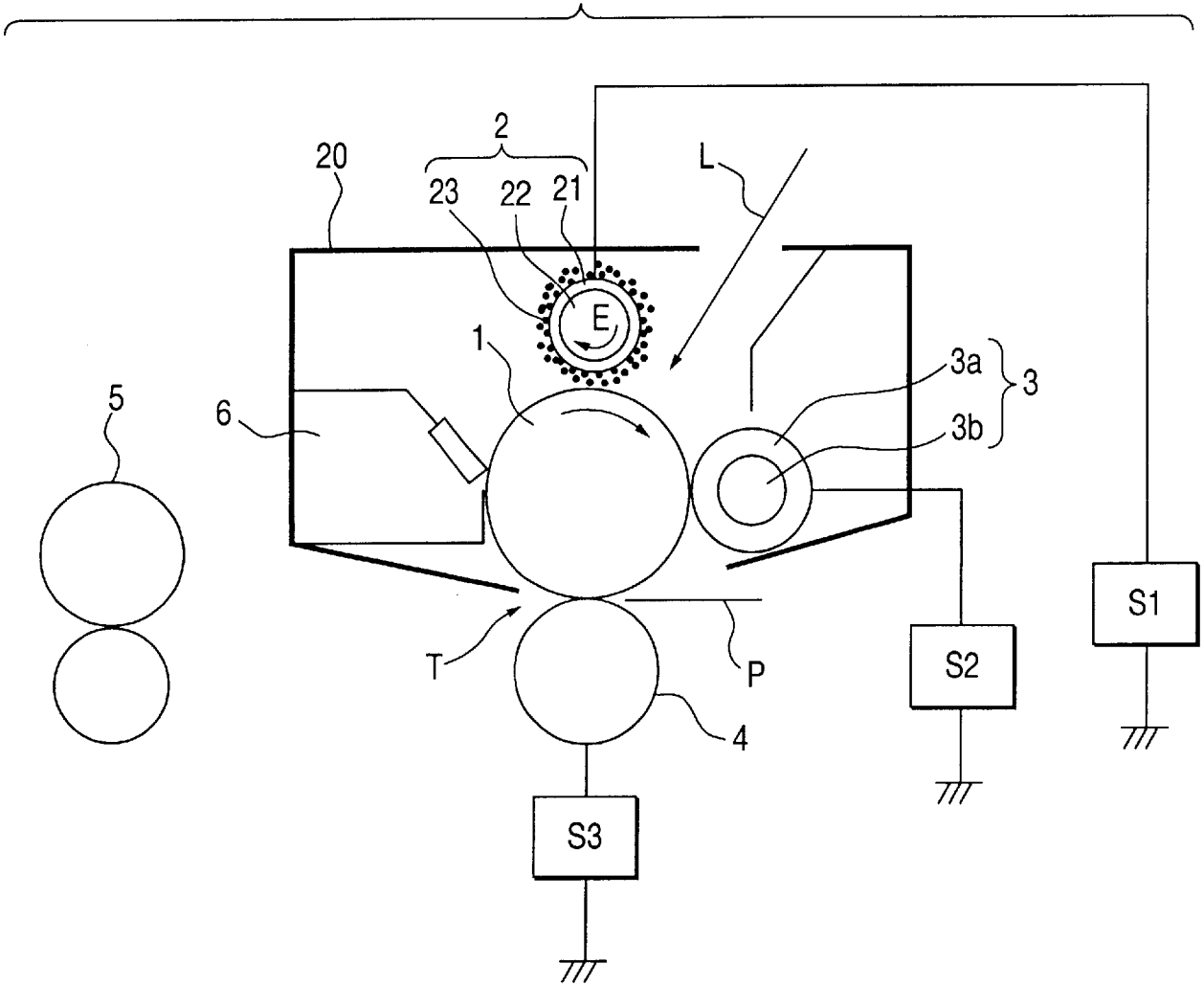
FIG. 1 shows schematically constitution of an electrophotographic apparatus equipped with the process cartridge having the electrophotographic photosensitive member of the present invention.

The electrophotographic photosensitive member of the present invention comprises a support, a photosensitive layer containing an organic charge-generating material and an organic charge-transporting material on the support, and a surface layer containing electroconductive particles on the photosensitive layer, and is charged by a charging member placed in contact therewith, and the electrophotographic photosensitive member has an electrostatic capacity of not less than 130 pF/cm$^2$.

In the present invention, the photosensitive member is considered to be charged uniformly in a high charge density by increasing the electrostatic capacity (C) up to 130 pF or larger per cm$^2$ of the photosensitive member to inject more electric charge.

The electrostatic capacity can be controlled by use of a material of a higher relative dielectric constant, by decreasing the thickness of a layer to be formed on the support, or by a like method.

In the present invention, the photosensitive member may preferably have an electrostatic capacity C of not more than 500 pF/cm$^2$ in view of non-uniform charging caused by the injection of carriers from the support.

The electrostatic capacity was measured as below in the present invention. An aluminum sheet is wound round an aluminum cylinder. Thereon, the layers of the photosensitive member, for example the photosensitive layer and the surface layer are formed under the same conditions as the practical layers. The aluminum sheet having the formed layers is measured for the electrostatic capacity by use of an impedance tester (YHP 4192A, manufactured by Yokogawa Hewlett Packard Co.).

The electroconductive particulate material in the surface layer includes particles of zinc oxide, titanium oxide, tin oxide, antimony oxide, indium oxide, bismuth oxide, tin-doped indium oxide, antimony-A or tantalum-doped tin oxide, zirconium oxide, and the like. Such a metal oxide may be used singly or in a mixture of two or more thereof. The mixture may be a solid solution or a fused matter.

The surface layer may contain a resin, if necessary. The resin includes polyesters, polycarbonates, polyurethane resins, acrylic resins, epoxy resins, silicone resins, alkyd resins, phenol resins, and vinyl chloride-vinyl acetate copolymers. In particular, excellent film strength and electroconductive particle dispersibility can be achieved by the surface layer which is formed by dispersing electroconductive particles in a photosetting acrylic monomer having two or more acryloyl groups in the molecule, applying the dispersion on a photosensitive layer, drying the applied dispersion, and photosetting the monomer.

The thickness of the surface layer of the present invention is in the range of preferably from 0.1 to 10 $\mu$m, more preferably from 1 to 5 $\mu$m.

For efficient injection charging, the surface layer has preferably a volume resistivity in the range of from $1\times10^9$ to $1\times10^{14}$ $\Omega\cdot$cm in the present invention.

The volume resistivity of the surface layer is measured by forming a surface layer on a polyethylene terephthalate (PET) film having platinum vapor-deposited on the surface and measuring DC voltage at 100 V under the conditions of 23° C. and 50% RH by a volume resistivity tester (4140B pAMATER, manufactured by Hewlett Packard Co.).

The photosensitive layer of in the present invention may be a single film type layer which contains an organic charge-generating material and an organic charge-transporting material in one and the same layer, or a lamination type layer which is constituted of a charge-generation layer containing an organic charge-generating material and a charge-transport layer containing a charge-transporting material. Of these, the lamination type is preferred.

The organic charge-generating material includes pyrylium dyes, thiopyrylium dyes, phthalocyanine pigments, anthanthorone pigments, dibenzopyrenequinone pigments, pyranthrone pigments, azo pigments, indigo pigments, quinacridone pigments, asymmetric quinocyanine, and quinocyanine.

The charge-generation layer can be formed by dispersing one part by weight of the above charge-generating material in 0.3 to 4 parts by weight of a binder resin such as a benzal resin or a butyral resin and a solvent by means of a dispersing apparatus such as a homogenizer, a ultrasonic mixer, a ball mill, a vibration mill, a sand mill, an attritor, and a roll mill, and applying and drying the liquid dispersion. The thickness of the layer is preferably not more than 5 $\mu$m, more preferably in the range of from 0.01 to 1 $\mu$m The organic charge-transporting material includes hydrazones, pyrazolones, styryl compounds, oxazoles, thiazoles, triarylmethanes, and polyarylalkanes.

The charge-transport layer can be formed by dissolving the aforementioned charge-transporting material and a binder in a solution and applying and drying the solution. The mixing ratio of the charge-transporting material to the binder resin is in the range of from about 2:1 to about 1:2. The solvent includes ketones such as acetone, and methyl ethyl ketone; esters such as methyl acetate, and ethyl acetate; aromatic hydrocarbons such as toluene, and xylene; and chlorohydrocarbons such as chlorobenzene, chloroform, and carbon tetrachloride. This solution can be applied by a coating method such as immersion coating, spray coating, and spinner coating. The applied solution may be dried at a temperature ranging from 10° C. to 200° C., more preferably from 20° C. to 150° C., for a time ranging preferably from 5 minutes to 5 hours, more preferably from 10 minutes to 2 hours, by ventilation or natural drying.

The binder resin for the charge-transport layer includes acrylic resins, styrene resins, polyesters, polycarbonates, polyarylates, polysulfones, polyphenylene oxides, epoxy resins, urethane resins, alkyd resins, and unsaturated resins. Particularly preferred are polymethyl methacrylate, polystyrene, styrene-acrylonitrile copolymers, polycarbonates, and diallyl phthalate resins.

The thickness of the charge-transport layer is preferably in the range of from 5 to 20 $\mu$m, more preferably from 10 to 18 $\mu$m.

The single film type photosensitive layer can be formed by dissolving and dispersing the charge-generating material, the charge-transporting material, and the binder resin as mentioned above in a solvent and applying and drying the resulting solution. The thickness of the photosensitive layer is preferably in the range of from 5 to 20 $\mu$m, more preferably from 10 to 18 $\mu$m.

The photosensitive layer of the present invention may contain an additive such as an antioxidant, a UV absorbing agent, and a lubricating agent.

The support may be made of any electroconductive material, including metals such as aluminum, and stainless steel; paper; and plastics in a form of a cylinder, a sheet, or a film. If necessary, the cylinder, sheet, or film may have an electroconductive polymer layer or a resin layer containing a particulate electroconductive material such as tin oxide, titanium oxide, and silver.

Between the support and the photosensitive layer, a subbing layer may be provided which functions as a barrier and an adhesive. The subbing layer has a thickness preferably ranging from about 0.2 to about 2 $\mu$m. The thickness of each layer may be measured by using an eddy current type film thickness measuring device (Permascope Type E 111, manufactured by Fischer Co.).

The charging member employed in the present invention includes a magnetic brush constituted of a magnetic particles, a fur brush, and a charging roller having an electroconductive rubber layer. The magnetic brush is preferred in view of the larger number of contact points.

The magnetic brush is constituted of particles of a magnetic material such as Zn—Cu ferrite. The magnetic brush is formed on a non-magnetic electroconductive sleeve enclosing a magnet therein.

The fur brush is formed from a polymer which has been treated for electroconductivity with carbon, copper sulfide, a metal, a metal oxide, or the like. The polymer includes rayon, acrylic resin, nylon, polypropylene, PET, and polyethylene. The fur is supported by a metal or a core material having been treated for electroconductivity.

The charging roller has a rubber layer or a resin layer which has been treated for electroconductivity provided on a cylinder.

The charging member has a resistance value ranging preferably from $1\times10^4$ to $1\times10^9$ Ω. The resistance of the charging member is obtained by measuring the electric current on application of a 100 V DC voltage through the charging member to an aluminum cylinder brought into contact in place of the photosensitive member, under the practical running conditions.

The voltage to be applied to the charging member is not limited in the present invention, provided that no electric discharge is caused substantially, that is, the electric charging is caused predominantly by charge injection. In this respect, the absolute value of the DC voltage ($V_{DC}$) preferably is not larger than the discharge initiation voltage ($V_{th}$). In relation with the surface potential ($V_D$) immediately after charging, the voltage satisfies preferably the equation:

$$|V_{DC}-V_D|\leqq 200\ (V)$$

For more uniform charging of the layer in the present invention, an AC voltage ($V_{AC}$) is preferably superposed. For substantial prevention of the electric discharge, i.e., for charging predominantly by charge injection, the peak-to-peak voltage ($V_{pp}$) of the $V_{AC}$; $V_{DC}$, $V_{th}$, and $V_D$ should satisfy the relation below:

$$|V_{DC}-V_D|\leqq 200\ (V)$$

$$|V_{pp}|<2\times|V_{th}|$$

$$|V_{pp}/2|+|V_{DC}|-|V_D|<|V_{th}|$$

The exposure means, the development means, and the transfer means are not specially limited.

The electrophotographic apparatus of the present invention is described by reference to specific examples.

FIG. 1 shows schematically the constitution of an electrophotographic apparatus of the present invention. This example relates to a laser beam printer.

In FIG. 1, the numeral 1 denotes an electrophotographic photosensitive member in a drum shape (hereinafter referred to as a "photosensitive drum"). In this example, the photosensitive drum is driven to rotate clockwise (as shown by the arrow mark) at a process speed (peripheral speed) of 100 mm/sec. A contact charging member 2 employing an electroconductive magnetic brush is brought into contact with the photosensitive drum 1. The contact charging member 2 is constituted of a rotatable non-magnetic electroconductive sleeve 21, a charging magnet 22, and magnetic particles 23 adhering to the sleeve 21 by the magnetic force of the charging magnet 22. A charging DC bias of −500 V is applied from a charging bias applying source S1 to charge uniformly the external peripheral face of the photosensitive drum 1 by injection charging at −500 V.

A laser beam, which is emitted from a laser beam scanner having a laser diode and a polygon mirror not shown in the drawing, is modulated in intensity in accordance with the digital signals of the image information of the object as electrical digital picture element signals in time sequence. The modulated laser beam L is allowed to scan the chargeable face of the photosensitive drum 1. Thereby, an electrostatic latent image is formed on the surface of the photosensitive drum 1 in accordance with the objective image information. The electrostatic latent image is developed as a toner image by a reversal development apparatus 3 by using a magnetic one-component insulating toner. For the development, the toner is allowed to coat the non-magnetic development sleeve 3*a* of 16 mm diameter enclosing a magnet 3*b*. This toner-coated development sleeve is placed at a distance of 300 $\mu$m from the surface of the photosensitive drum 1, and is rotated at the same speed as the photosensitive drum 1. Simultaneously, a development bias voltage is applied to the sleeve 3*a* by a development bias voltage source S2. The applied voltage is superposition of a DC voltage of −400 V and a rectangular AC voltage of a frequency of 1800 Hz and a peak-to-peak voltage of 1600 V, and the jumping development is caused between the sleeve 3*a* and the photosensitive drum 1.

On the other hand, a transfer-receiving material P is fed as the recording medium from a sheet-feeder not shown in the drawing, and is introduced to the nip T (transfer portion) between the photosensitive drum 1 and transfer roller 4 of a medium electric resistance as a contact transfer means pressed against the drum at a prescribed pressure at a prescribed timing. To the transfer roller 4, a prescribed transfer bias voltage is applied by a transfer bias voltage source S3. In this example, the roller has a resistance of $5\times10^8$ Ω, and a DC voltage of +2000 V is applied for the image transfer.

The transfer-receiving material P introduced to the transfer portion T is caught at the transfer portion T and forwarded to transfer the toner image formed on the surface of the photosensitive drum 1 to the face of the transfer-receiving material P successively by the electrostatic force and the pressure.

The transfer-receiving material P having received the toner image is separated from the face of the photosensitive drum 1, introduced to a fixing device 5 of heat fixing type or a like type to fix the toner image, and sent out of the apparatus as a print or copy.

After the toner image transfer to the transfer-receiving material P, the surface of the photosensitive drum is cleaned by a cleaning device 6 to remove the adhering matter like the remaining toner for repeated image-formation.

The electrophotographic apparatus of this example is a demountable cartridge type apparatus which comprises four process devices of a photosensitive drum 1, a contact charging means 2, a development device 3, and a cleaning device 6 in integration into a cartridge 20. However the apparatus of the present invention is not limited thereto.

Figure 2:
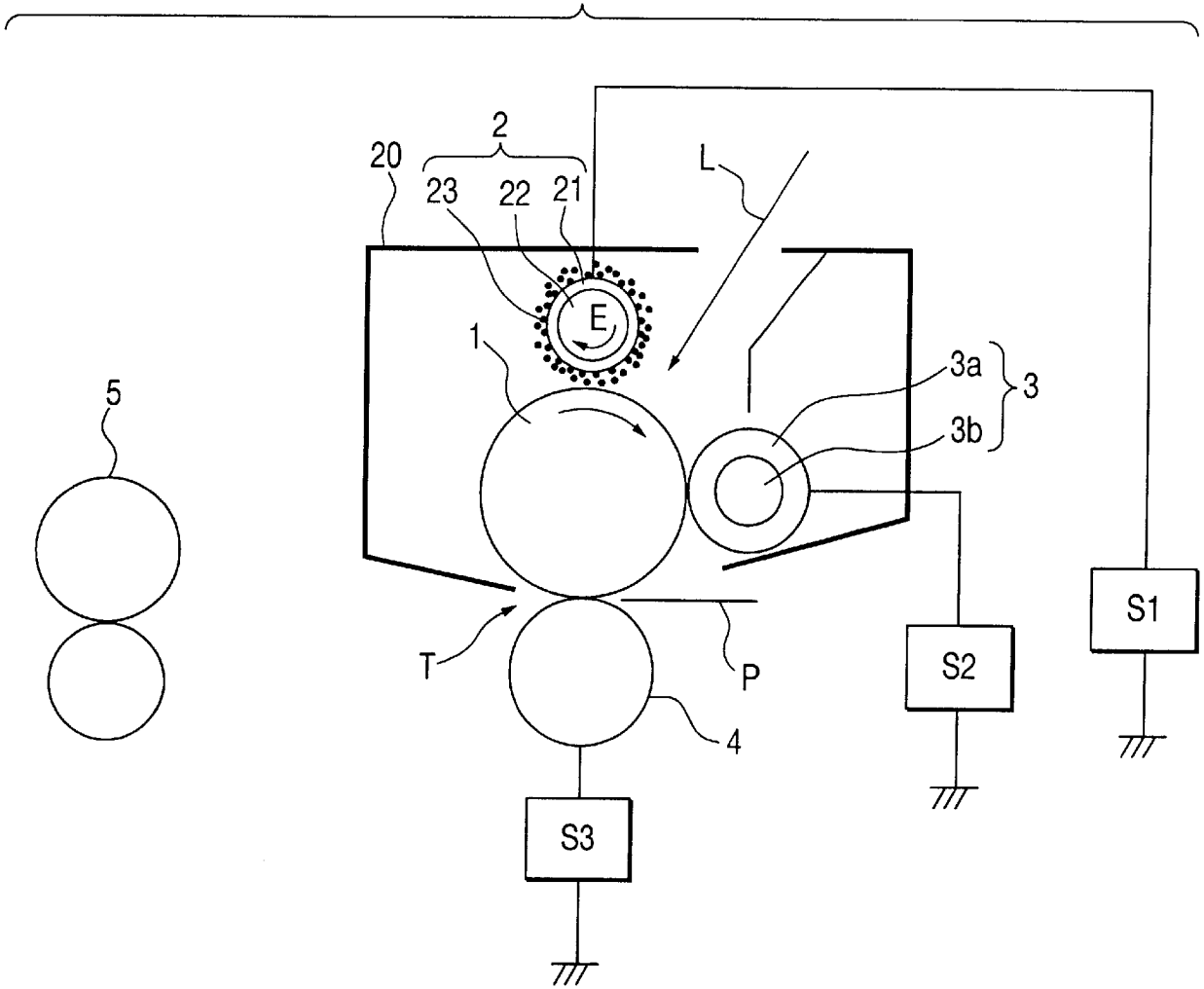
FIG. 2 shows schematically constitution of another electrophotographic apparatus equipped with the process cartridge having the electrophotographic photosensitive member of the present invention.

FIG. 2 shows another specific example of the electrophotographic apparatus of the present invention. The apparatus of this example is the same as the one shown in FIG. 1 except that the cleaning device is not provided. In FIG. 2, the same reference numbers are used for the same members as in FIG. 1 respectively. In the apparatus shown in FIG. 2, the remaining toner on the photosensitive drum after the image transfer is caught once by a magnetic brush formed by magnetic particles 23, and sent later in a suitable time onto the photosensitive drum; or passes through the magnetic brush and is recovered finally by the development device 3. The development device 3 is preferably of a two-component type.

The present invention is explained by Examples. In Examples, the unit "parts" is based on weight unless otherwise mentioned.

EXAMPLE 1

On an aluminum cylinder of 30 mm in diameter and 260.5 mm in length, an electroconductive layer of 15 $\mu$m thick was formed by applying, by immersion coating, a solution composed of 10 parts of tin oxide-coated barium sulfate, 2 parts of titanium oxide, 6 parts of a phenol resin, 0.001 part of a silicone oil, 4 parts of methanol, and 16 parts of methoxypropanol, and thermosetting the applied matter at 140° C. for 30 minutes. On the formed electroconductive layer, a subbing layer was formed in a thickness of 0.5 $\mu$m by applying and drying a solution of 5% by weight of a polyamide resin (Amilan CM8000: trade name, Toray Industries, Inc.) in methanol by immersion coating.

Separately, 4 parts of an oxyphthalocyanine pigment having strong peaks of Bragg angle 2θ+0.2° at 9.0°, 14.2°, 23.9°, and 27.1°, 2 parts of a polyvinylbutyral resin (BX-1: trade name, Sekisui Chemical Co., Ltd.), and 80 parts of cyclohexanone were treated for dispersion in a sand mill with glass beads of 1 mm in diameter for 4 hours. To the liquid dispersion, 100 parts of ethyl acetate was added. The resulting mixture was applied on the above subbing layer and dried to form a charge generation layer of 0.2 $\mu$m thick.

Ten parts of a styryl compound represented by the formula below:

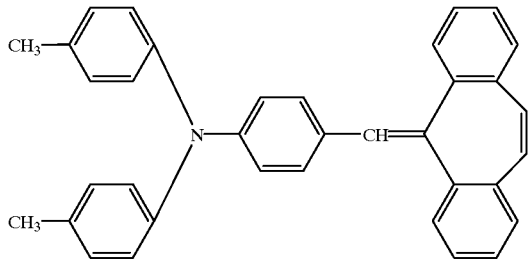

and 10 parts of a bisphenol Z type polycarbonate (Z-200: trade name, Mitsubishi Gas Chemical Co., Inc.) were dissolved in 100 part of monochlorobenzene. This solution was applied onto the above charge generation layer, and the applied solution was dried by hot-air drying at 105° C. for one hour to form a charge transport layer of 13 $\mu$m thick.

Separately, 25 parts of an acrylic monomer represented by the formula below:

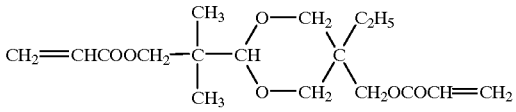

50 parts of particulate antimony-doped tin oxide (number-average particle diameter 0.03 $\mu$m) having been treated with the compound represented by the formula below (treatment amount: 7%):

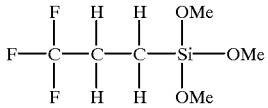

and 150 parts of ethanol were treated for dispersion with a sand mill for 66 hours, and further thereto 20 parts of particulate polytetrafluoroethylene (number-average particle diameter: 0.18 $\mu$m) was added and dispersed. Further, 3 parts of 2-methylthioxanthone as a photopolymerization initiator, and 9 parts of a compound represented by the formula below as a second photopolymerization initiator:

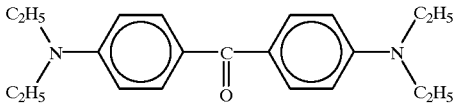

were dissolved therein to form a solution for surface layer formation.

This solution was applied onto the above charge transport layer by immersion coating. The coating layer was cured by photo-setting by illumination for 60 seconds with a high-pressure mercury lamp at light intensity of 160 mW/cm$^2$. Then the cured layer was dried at 120° C. by hot-air drying for 2 hours to obtain a surface layer. The surface layer had a thickness of 3 $\mu$m. The dispersion in the surface layer-forming solution was satisfactory and the surface layer had a uniform flat face without irregularity. The surface layer had a volume resistivity of $1\times10^{13}$ Ω·cm, and the resulting photosensitive member had an electrostatic capacity of 196 pF/cm$^2$.

This photosensitive member was evaluated by image formation by use of an electrophotographic apparatus shown by FIG. 1. In the apparatus, a particulate Zn—Cu ferrite was used as the magnetic particles for the charging member. The magnetic brush was rotated at a peripheral speed of 50 mm/sec in a direction reverse to the surface movement direction of the photosensitive member at the contact site. The charging member had a resistance value of $1\times10^6$ Ω. To the charging member, was applied a pulse voltage composed of a DC voltage of −500 V and an AC voltage of $V_{pp}$ of 700 V. In the evaluation, a half tone image of 2-dot/2-space was output under environmental conditions of 20° C. and 5% RH. The image of the initial output stage was examined visually for the presence of defects such as streaks in the image. Further, the image after 10,000 sheets of the halftone image were output under environmental conditions of 30° C. and 80% RH was examined microscopically for the reproducibility of the dots. The results are shown in Table 1.

EXAMPLES 2–3

A photosensitive member was prepared and evaluated in the same manner as in Example 1 except that the thickness of the charge transport layer was changed to 15 μm, or 18 μm. The results are shown in Table 1.

COMPARATIVE EXAMPLES 1–3

A photosensitive member was prepared and evaluated in the same manner as in Example 1 except that the thickness of the charge transport layer was changed to 22 μm, 25 μm, or 30 μm. The results are shown in Table 1.

EXAMPLES 4–6

A photosensitive member was prepared and evaluated in the same manner as in Example 1 except that the hydrazone compound represented by the formula below:

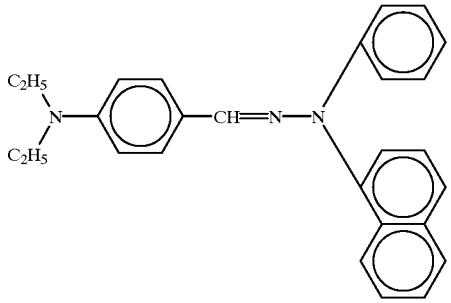

was used in place of the styryl compound; polymethyl methacrylate was used in place of the bisphenol A type polycarbonate; the charge transport layer was prepared in a thickness of 13 μm, 15 μm, or 20 μm in the respective Examples; and the DC voltage only was applied to the charging member. The results are shown in Table 1.

COMPARATIVE EXAMPLES 4–6

A photosensitive member was prepared and evaluated in the same manner as in Example 4 except that the thickness of the charge transport layer was changed to 25 μm, 30 μm, or 35 μm. The results are shown in Table 1.

EXAMPLES 7–9

A photosensitive member was prepared and evaluated in the same manner as in Examples 1–3 except that the charging member was changed to a fur brush of an electroconductive rayon fiber (REC-C, produced by Unitika Ltd.). The fur brush had a resistance of $5\times10^5$ Ω. The fur brush was rotated at a peripheral speed of 200 mm/sec in a direction reverse to the surface movement direction of the photosensitive member at the contact site. The results are shown in Table 1.

COMPARATIVE EXAMPLES 7–9

A photosensitive member was prepared and evaluated in the same manner as in Example 7 except that the thickness of the charge transport layer was changed to 22 μm, 25 μm, or 30 μm. The results are shown in Table 1.

EXAMPLES 10–12

A photosensitive member was prepared and evaluated in the same manner as in Examples 1–3 except that the electrophotographic apparatus employed was the one shown by FIG. 2. The development was conducted with two components. The results are shown in Table 1.

COMPARATIVE EXAMPLES 10–12

A photosensitive member was prepared and evaluated in the same manner as in Example 10 except that the thickness of the charge transport layer was changed to 22 μm, 25 μm, or 30 μm. The results are shown in Table 1.

TABLE 1

| | Electrostatic capacity of photosensitive member (pF/cm$^2$) | Image | Dot reproducibility |
|---|---|---|---|
| Examples | | | |
| 1 | 196 | Good | Good |
| 2 | 170 | Good | Good |
| 3 | 140 | Good | Good |
| 4 | 200 | Good | Good |
| 5 | 175 | Good | Good |
| 6 | 132 | Good | Good |
| 7 | 196 | Good | Good |
| 8 | 170 | Good | Good |
| 9 | 140 | Good | Good |
| 10 | 196 | Good | Good |
| 11 | 170 | Good | Good |
| 12 | 140 | Good | Good |
| Comparative Examples | | | |
| 1 | 116 | Good | Slight blurring |
| 2 | 102 | Good | Blurring |
| 3 | 85 | Good | Blurring |
| 4 | 108 | Good | Blurring |
| 5 | 91 | Good | Blurring |
| 6 | 98 | Good | Blurring |
| 7 | 116 | Streaking | Slight blurring |
| 8 | 102 | Streaking | Blurring |
| 9 | 85 | Streaking | Blurring |
| 10 | 116 | Good | Slight blurring |
| 11 | 102 | Good | Slight blurring |
| 12 | 85 | Good | Slight blurring |

What is claimed is:

1. A process cartridge comprising an electrophotographic photosensitive member having a support, a photosensitive layer containing an organic charge-generating material and an organic charge transporting material on the support, and a surface layer containing electroconductive particles on the photosensitive layer; and at least one of a charging member placed in contact with the electrophotographic photosensitive member for charging the electrophotographic member by application of a voltage, a development means, and a cleaning means integrated into one body, and being detached from the main body of an electrophotographic apparatus, wherein the electrophotographic photosensitive member has an electrostatic capacity of not less than 130 pF per cm$^2$, and wherein a DC voltage ($V_{DC}$) and an AC voltage are applied in superposition to the charging member, and the $V_{DC}$, the peak-to-peak voltage ($V_{pp}$) of the AC voltage, the surface potential ($V_D$) of the photosensitive member immediately after the charging, and the discharge initiation voltage ($V_{th}$) satisfy the equations below:

$$|V_{DC}-V_D|\leqq 200\ (V)$$

$$|V_{pp}|<2\times|V_{th}|$$

$$|V_{pp}/2|+|V_{DC}|-|V_D|<|V_{th}|.$$

2. The process cartridge according to claim 1, wherein the surface layer has a volume resistivity ranging from $1\times10^9$ to $1\times10^{14}$ Ω·cm.

3. The process cartridge according to claim 1, wherein the charging member has a resistance value ranging from $1\times10^4$ to $1\times10^{9}$Ω.

4. The process cartridge according to claim 1, wherein the charging member is a magnetic brush formed from magnetic particles.

5. The process cartridge according to claim 1, wherein the photosensitive layer has a thickness ranging from 5 to 20 $\mu$m.

6. The process cartridge according to claim 5, wherein the photosensitive layer has a thickness ranging from 10 to 18 $\mu$m.

7. The process cartridge according to claim 1, wherein the development means serves substantially as the cleaning means.

8. An electrophotographic apparatus comprising an electrophotographic photosensitive member having a support, a photosensitive layer containing an organic charge-generating material and an organic charge transporting material on the support, and a surface layer containing electroconductive particles on the photosensitive layer; a charging member placed in contact with the electrophotographic photosensitive member for charging the electrophotographic photosensitive member by application of a voltage; a light exposure means, a development means, and an image transfer means, wherein the electrophotographic photosensitive member has an electrostatic capacity of not less than 130 pF per $cm^2$ and wherein a DC voltage ($V_{DC}$) and an AC voltage are applied in superposition to the charging member, and the $V_{DC}$, the peak-to-peak voltage ($V_{pp}$) of the AC voltage, the surface potential ($V_D$) of the photosensitive member immediately after the charging, and the discharge initiation voltage ($V_{th}$) satisfy the equations below:

$$|V_{DC}-V_D| \leqq 200 \text{ (V)}$$

$$|V_{pp}| < 2\times|V_{th}|$$

$$|V_{pp}/2|+|V_{DC}|-|V_D| < |V_{th}|.$$

9. The electrophotographic apparatus according to claim 8, wherein the surface layer has a volume resistivity ranging from $1\times10^9$ to $1\times10^{14}$ $\Omega\cdot$cm.

10. The electrophotographic apparatus according to claim 8, wherein the charging member has a resistance value ranging from $1\times10^4$ to $1\times10^9$ $\Omega$.

11. The electrophotographic apparatus according to claim 8, wherein the charging member is a magnetic brush formed from magnetic particles.

12. The electrophotographic apparatus according to claim 8, wherein the photosensitive layer has a thickness ranging from 5 to 20 $\mu$m.

13. The electrophotographic apparatus according to claim 12, wherein the photosensitive layer has a thickness ranging from 10 to 18 $\mu$m.

14. The electrophotographic apparatus according to claim 8, wherein the development means serves substantially as the cleaning means.

* * * * *